US010321797B2

(12) United States Patent
Montgomery et al.

(10) Patent No.: US 10,321,797 B2
(45) Date of Patent: Jun. 18, 2019

(54) PUMP PLATE FOR CONDITIONING FLUID FLOW IN A DISHWASHER

(71) Applicant: Electrolux Home Products, Inc., Charlotte, NC (US)

(72) Inventors: Mark D. Montgomery, Kinston, NC (US); David Costa, Kinston, NC (US); Ashish A. Verma, Kinston, NC (US); Jerry L. Olesen, Kinston, NC (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 559 days.

(21) Appl. No.: 14/909,680

(22) PCT Filed: Aug. 2, 2013

(86) PCT No.: PCT/US2013/053382
§ 371 (c)(1),
(2) Date: Feb. 2, 2016

(87) PCT Pub. No.: WO2015/016939
PCT Pub. Date: Feb. 5, 2015

(65) Prior Publication Data

US 2016/0174806 A1 Jun. 23, 2016

(51) Int. Cl.
*F04D 29/18* (2006.01)
*A47L 15/42* (2006.01)
(Continued)

(52) U.S. Cl.
CPC ..... *A47L 15/4225* (2013.01); *F04D 29/18* (2013.01); *F04D 29/448* (2013.01); *F04D 29/548* (2013.01)

(58) Field of Classification Search
CPC ..... A47L 15/4225; A47L 15/06; A47L 15/08; F04D 29/18; F04D 29/448; F04D 29/548
See application file for complete search history.

(56) References Cited

U.S. PATENT DOCUMENTS 1,722,272 A 7/1929 Buck et al.
2,654,377 A 10/1953 Sway
(Continued)

FOREIGN PATENT DOCUMENTS

DE 2508302 B1 4/1976
DE 2945929 A1 5/1981
(Continued)

OTHER PUBLICATIONS

International Searching Authority, International Search Report and Written Opinion for International Application No. PCT/US2013/053382, dated Sep. 27, 2013, 13 pages, European Patent Office, The Netherlands.

*Primary Examiner* — Jason D Shanske
*Assistant Examiner* — Joshua R Beebe
(74) *Attorney, Agent, or Firm* — Alston & Bird LLP

(57) ABSTRACT

The present invention provides a pump plate (60) for conditioning the flow of a fluid before the fluid enters an inlet (51) of a circulation pump (50) of a dishwasher. The pump plate (60) may have a plate portion with a number of holes (62) dispersed across its surface such that fluid may flow through the holes (62). The pump plate (60) may also include one or more upper guide vanes (63) extending outwardly from the plate portion and configured to reduce the turbulence in the fluid flow. A dishwasher (10) including a pump plate (60) and a method for manufacturing such a dishwasher are also provided. A dishwasher (10) that includes a pump plate (60) to condition the fluid flow within the dishwasher may be configured to function efficiently while requiring less water to complete a rinse or wash cycle than a dishwasher that does not include a pump plate.

36 Claims, 8 Drawing Sheets

(51) Int. Cl.
*F04D 29/44* (2006.01)
*F04D 29/54* (2006.01)

(56) References Cited

U.S. PATENT DOCUMENTS 2,965,112 A * 12/1960 Getchell ..... A47L 15/4223 134/176
3,084,701 A 4/1963 Hardy et al.
3,108,607 A * 10/1963 Blakeslee ..... A47L 15/4225 134/104.4
3,126,900 A 3/1964 Zane et al.
3,179,307 A 4/1965 Duncan et al.
3,210,009 A 10/1965 Long et al.
3,217,884 A * 11/1965 Long ..... B01D 29/115 210/108
3,322,285 A * 5/1967 Lopp ..... A47L 15/4204 134/111
3,335,867 A * 8/1967 Perl ..... A47L 15/4204 134/111
3,415,261 A 12/1968 Long
3,446,155 A 5/1969 Guth
4,168,615 A 9/1979 Condit
5,143,513 A 9/1992 Ellingson et al.
5,529,080 A 6/1996 Minkin
5,762,107 A 6/1998 Laws
6,840,275 B2 * 1/2005 Grayson ..... B64G 1/402 137/561 A
7,261,111 B2 * 8/2007 Marettek ..... A47L 15/4204 134/104.1
7,763,119 B2 * 7/2010 Bigott ..... A47L 15/08 134/113
7,985,300 B2 * 7/2011 Lee ..... A47L 15/4225 134/56 D
8,136,980 B2 3/2012 Smith
8,177,915 B2 5/2012 Francisco et al.
8,201,569 B2 6/2012 Goodyear et al.
2010/0012159 A1 1/2010 Verma et al.
2010/0288306 A1 11/2010 Francisco et al.
2011/0016927 A1 1/2011 Kim et al.

FOREIGN PATENT DOCUMENTS

DE 102009001600 A1 9/2010
DE 102010039566 A1 2/2012
GB 803629 A 10/1958
GB 942273 A 11/1963
JP 57198379 A 12/1982
JP 2000051135 A * 2/2000

* cited by examiner

PUMP PLATE FOR CONDITIONING FLUID FLOW IN A DISHWASHER

CROSS REFERENCE TO RELATED APPLICATIONS

This application is a national stage application, filed under 35 U.S.C. § 371, of International Application No. PCT/US2013/053382, filed Aug. 2, 2013, the contents of which are hereby incorporated by reference in its entirety.

FIELD

Embodiments of the present invention relate to dishwashing appliances and, more particularly, to systems, methods, and apparatuses for conditioning fluid flow in a dishwasher.

BACKGROUND

Dishwashers have become an integral part of everyday household use. Consumers place dishware and other utensils onto dishwasher racks inside dishwashers for cleaning. Dishwashers typically clean the dishware with wash systems that utilize spray arms and spray jets to propel water and/or wash fluid onto the dishware to remove food particles and otherwise clean the dishware.

Dishwashers typically comprise a sump in the base of the dishwasher tub. The wash fluid in the dishwasher runs down inside of the dishwasher tub and collects in the sump. A circulation pump then recirculates the collected wash fluid through one or more spray arms inside the dishwasher. For the circulation pump to efficiently recirculate the wash fluid, it is important to prevent air and/or vapor from entering the pump (i.e., starving or cavitating the pump). Therefore, during operation, the inlet of the circulation pump is fully submerged (e.g., covered) by a minimum level of wash fluid to ensure that air and/or vapor doesn't enter the circulation pump inlet.

Energy and water conservation is important and, thus, there is a desire to reduce the amount of water used in dishwashers. However, simply reducing the amount of water used by a dishwasher reduces the amount of wash fluid available for sufficiently submerging the inlet to the circulation pump. As noted above, if the fluid level at the circulation pump inlet is not sufficient, the circulation pump will starve to some degree, causing the circulation pump to work inefficiently and/or fail. Indeed, in some cases, a large volume of wash fluid is needed to ensure that the fluid level at the circulation pump inlet remains sufficient at all times during operation. This is due to the fact that, during operation, wash fluid may be spread throughout the dishwasher tub (e.g., in the circulation system, in the spray arms, in upside down dishware, running down the dishwasher tub, etc.). In some embodiments, the fluid height at the pump inlet can provide the pressure necessary at the circulation pump inlet to prevent cavitation by keeping the pressure along the blades of the impeller above the vapor pressure. Increased fluid height at the circulation pump inlet also helps to avoid the formation of vortices in the fluid that can draw vapor down into the pump inlet, a process called carry under. These vortices can be formed where fluid acceleration into and near the circulation pump inlet is relatively high and the available pressure, due to fluid height, is not sufficient to prevent the vapor from being drawn down into the fluid. As the fluid height increases the buoyant force available for lifting vapor up through the fluid to escape or to prevent it from being drawn down into the wash fluid to the circulation pump inlet is increased. The actual volume of wash fluid necessary to achieve the required fluid height is dependent upon the geometry below the fluid level, especially that of the sump and tub.

In a dishwasher, the wash fluid is sprayed onto the dishware by one or more spray arms. The wash fluid then drips off the dishware and/or runs down the sides of the tub to the bottom of the tub and into the sump. Due to the nearly infinite number of possible dishware configurations within the dishwasher, the flow of the wash fluid into the sump of the dishwasher is difficult to predict. In this regard, air may enter the fluid returning to the pump in a variety of ways. This includes at least the aeration that may occur as fluid passes through a filter mesh and the entrainment of air in the fluid due to the capture of air during unbounded flow, as in the case of flow over an obstruction like a rib or ledge or the crashing of waves droplets or streams into the fluid surface. Wash fluid flowing from different parts of the tub tends to carry various angular and linear momentums in various directions, resulting in a turbulent flow. The turbulence of the fluid flow can pull air downwards and thus works against the natural buoyant forces that would otherwise cause the air to rise up and out of the fluid. Turbulence may also result in fluid momentum in directions that are opposed to what the circulation pump is designed to create and that are, by definition, not the preferred, laminar flow. Turbulent flow may also contribute to the creation of vortices that pull air and/or vapor down into the pool at the circulation pump inlet, increasing the air and/or vapor passing through the circulation pump. Unsteady and turbulent flow can also result in an uneven fluid surface height with the low points being more susceptible to the creation of vortices that can cause carry under.

BRIEF SUMMARY

Embodiments of the present invention dissipate the random angular and linear momentum components in the fluid flow in order to settle the wash fluid prior to entrance into the circulation pump inlet by way of a pump plate as described herein. The pump plate for conditioning fluid flow in a dishwasher described herein reduces the turbulence in the flow of wash fluid in the sump of a dishwasher thereby increasing fluid flow efficiency and also allowing a dishwasher to function with less water while maintaining efficient operation of the circulation pump.

In various embodiments, the pump plate comprises a plate portion defining a first surface and a second surface. A plurality of holes may be defined in the plate portion and may extend between the first surface and the second surface. The plurality of holes may be dispersed across the plate portion and configured to allow fluid to pass through the plate portion. The pump plate may further include at least one first upper guide vane extending outwardly from the first surface and at least one second upper guide vane extending outwardly from the first surface. The at least one second upper guide vane may intersect with the at least one first upper guide vane.

In some embodiments, the pump plate further includes a first lower guide vane extending outwardly from the second surface. The first lower guide vane defines a first side and a second side. The pump plate may further include a second lower guide vane extending outwardly from the first side and the second side of the first lower guide vane. The second lower guide vane may extend in a plane that is perpendicular to the first lower guide vane and parallel to the plate portion.

In some embodiments, the at least one first upper guide vane comprises a plurality of upper guide vanes. In some such embodiments, at least two of the plurality of first upper guide vanes extend outwardly from the plate portion at different heights and/or at least two of the plurality of first upper guide vanes extend along the plate portion to define different lengths.

In some embodiments, the at least one first upper guide vane and the at least one second upper guide vane are perpendicular to the first surface.

In some embodiments, the at least one first upper guide vane comprises a plurality of first upper guide vanes, and the at least one second upper guide vane comprises a plurality of second upper guide vanes In some embodiments, two of the plurality of first upper guide vanes are spaced apart and each intersect with one of the second upper guide vanes to form a channel. The channel may be configured to align with at least one of the plurality of holes defined in the plate portion such that fluid is conditioned to flow through the channel and the at least one of the plurality of holes aligned with the channel. In some embodiments, the plurality of first upper guide vanes and the plurality of second upper guide vanes may intersect to form a plurality of channels. Each channel may be configured to align with at least one of the plurality of holes defined in the plate portion such that fluid is conditioned to flow through the channel and the at least one of the plurality of holes aligned with the channel.

BRIEF DESCRIPTION OF THE FIGURES

Figure 1:
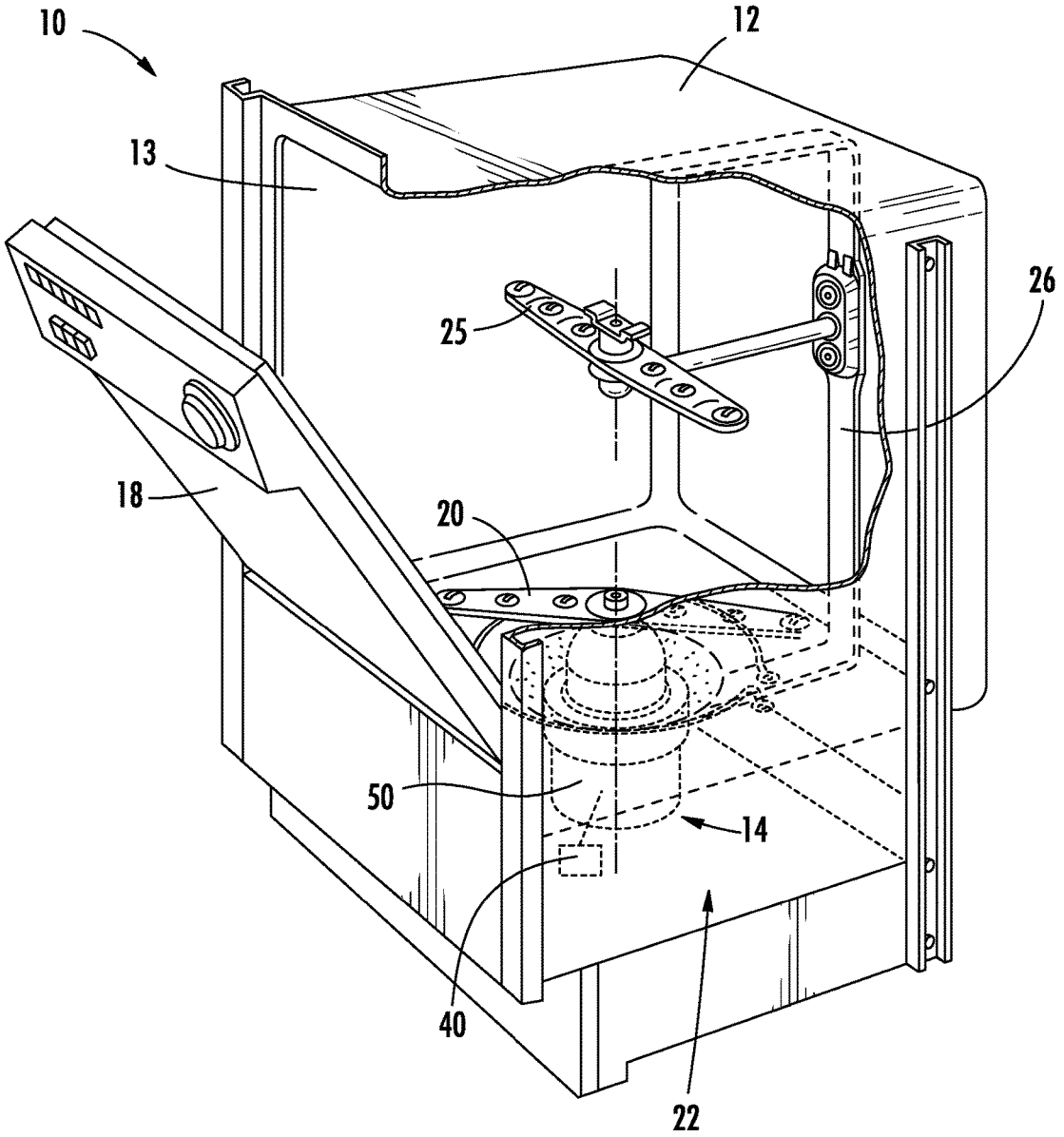
Figure 2:
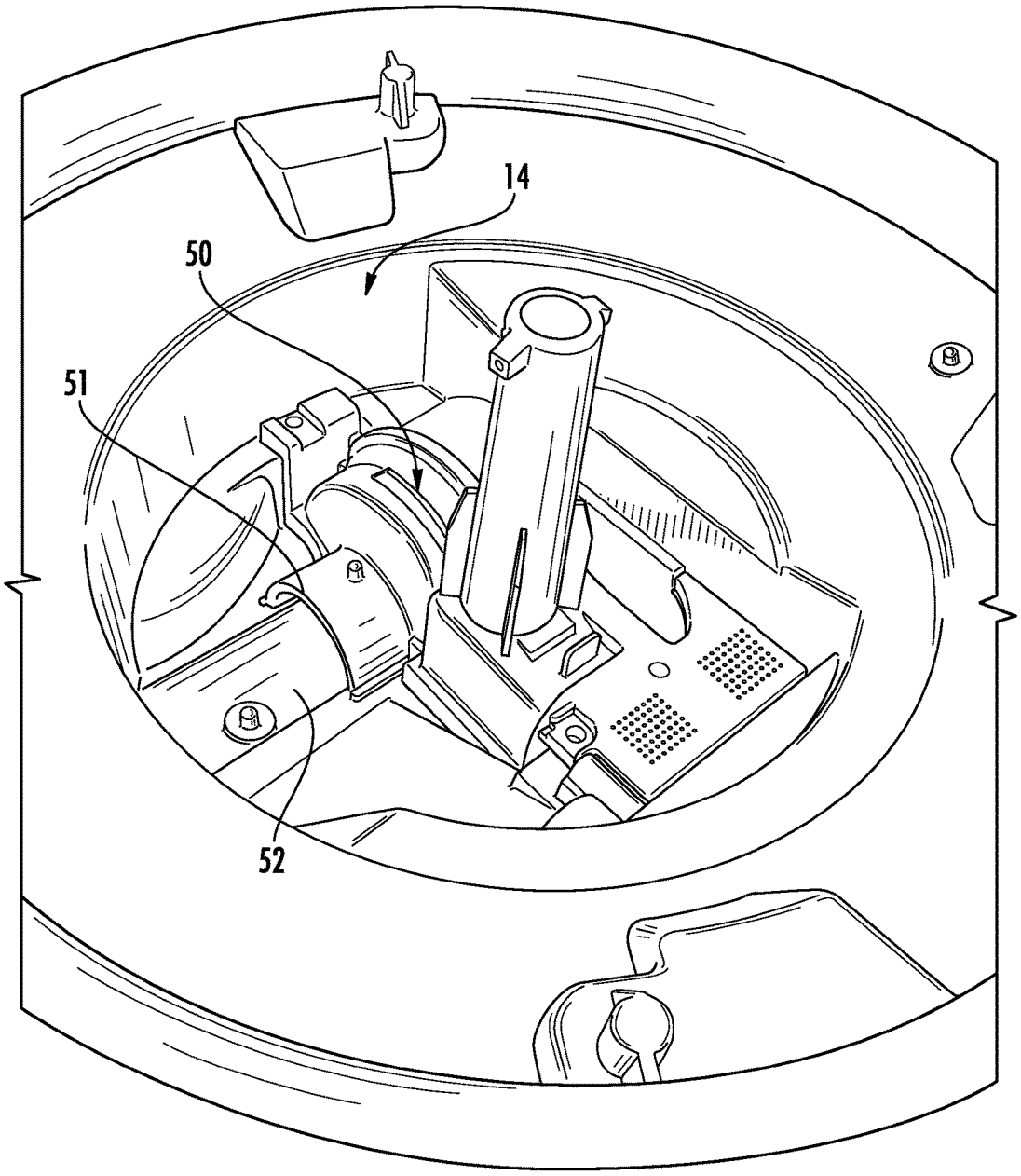
Figure 3:
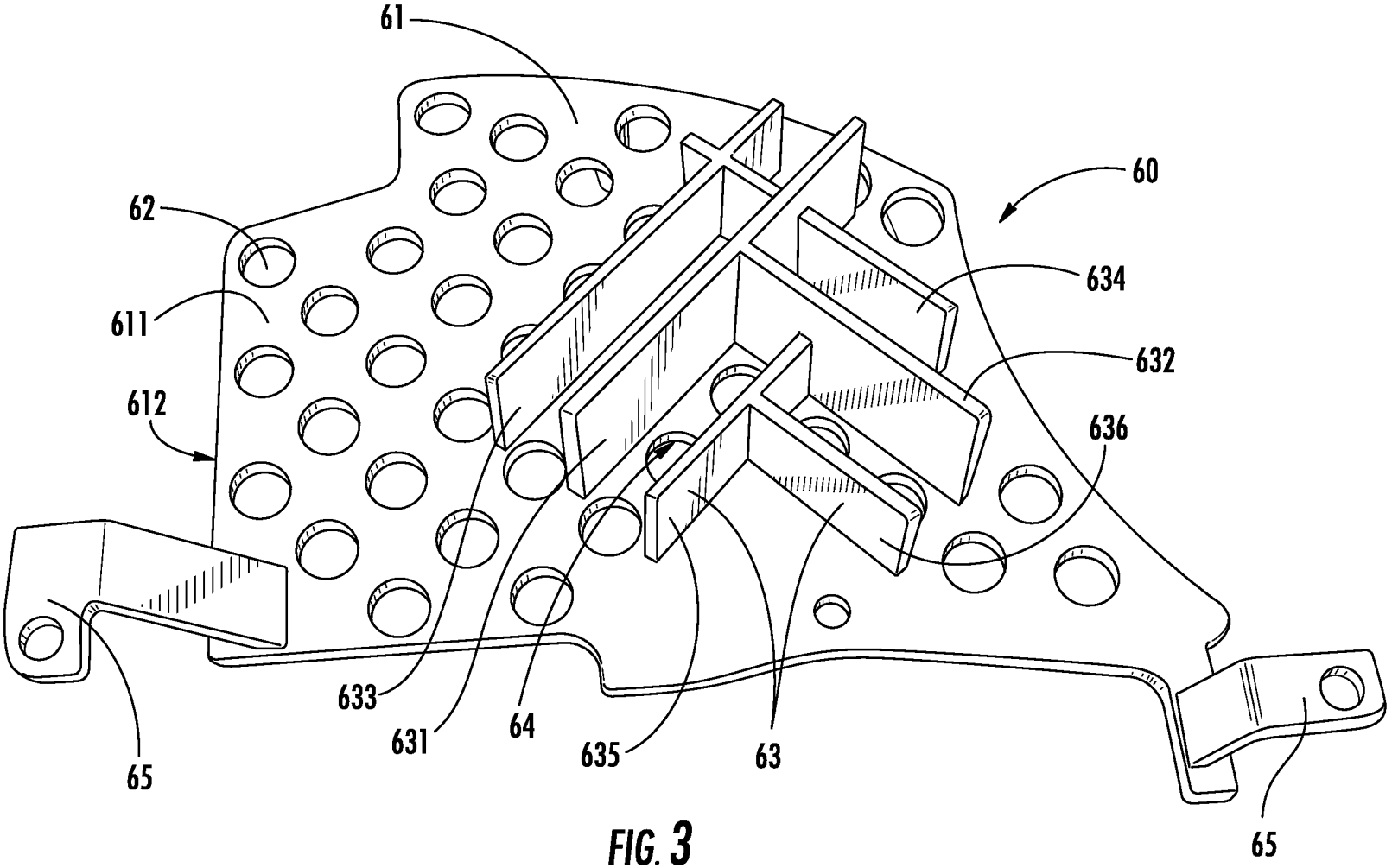
Figure 4:
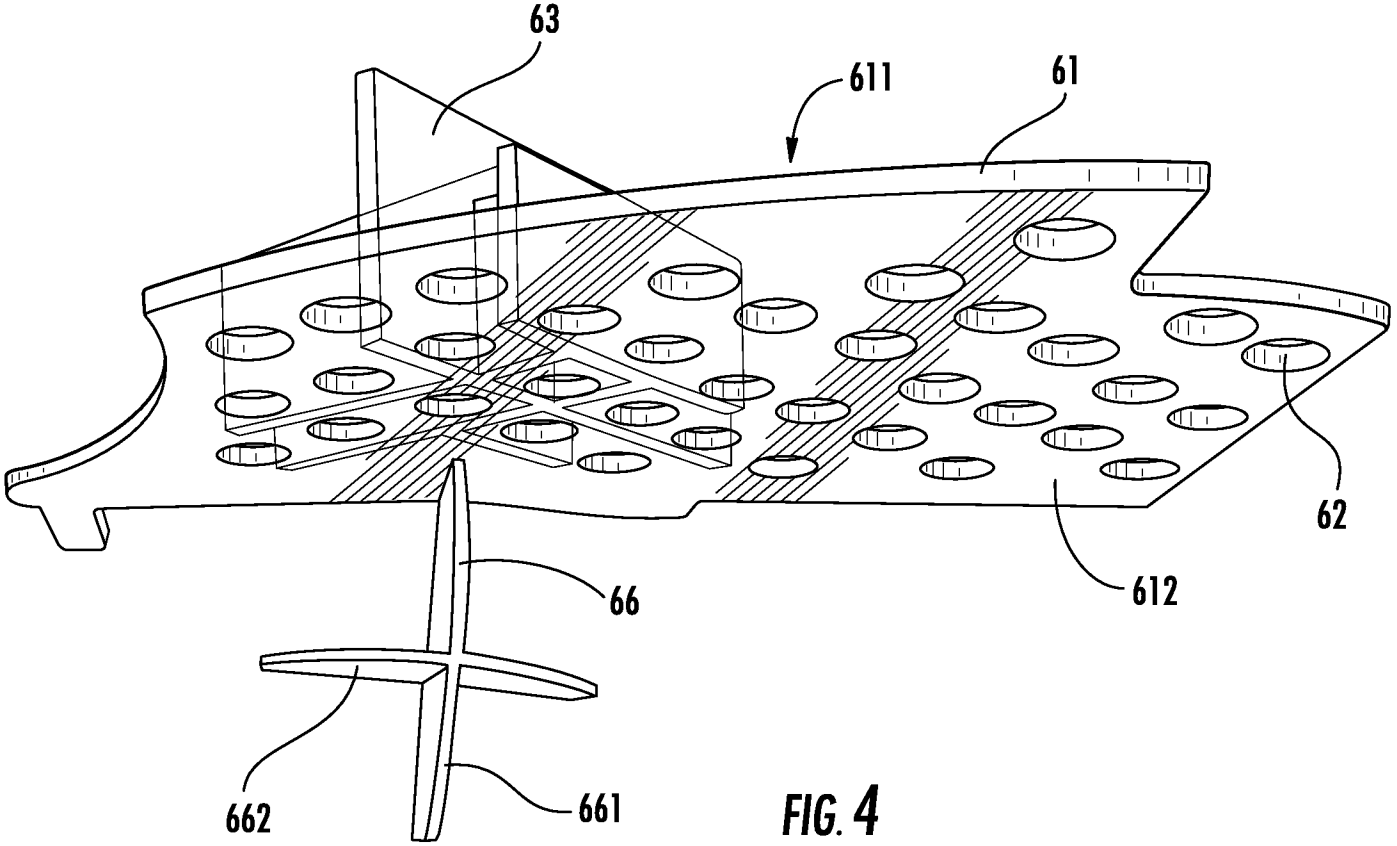
Figure 5:
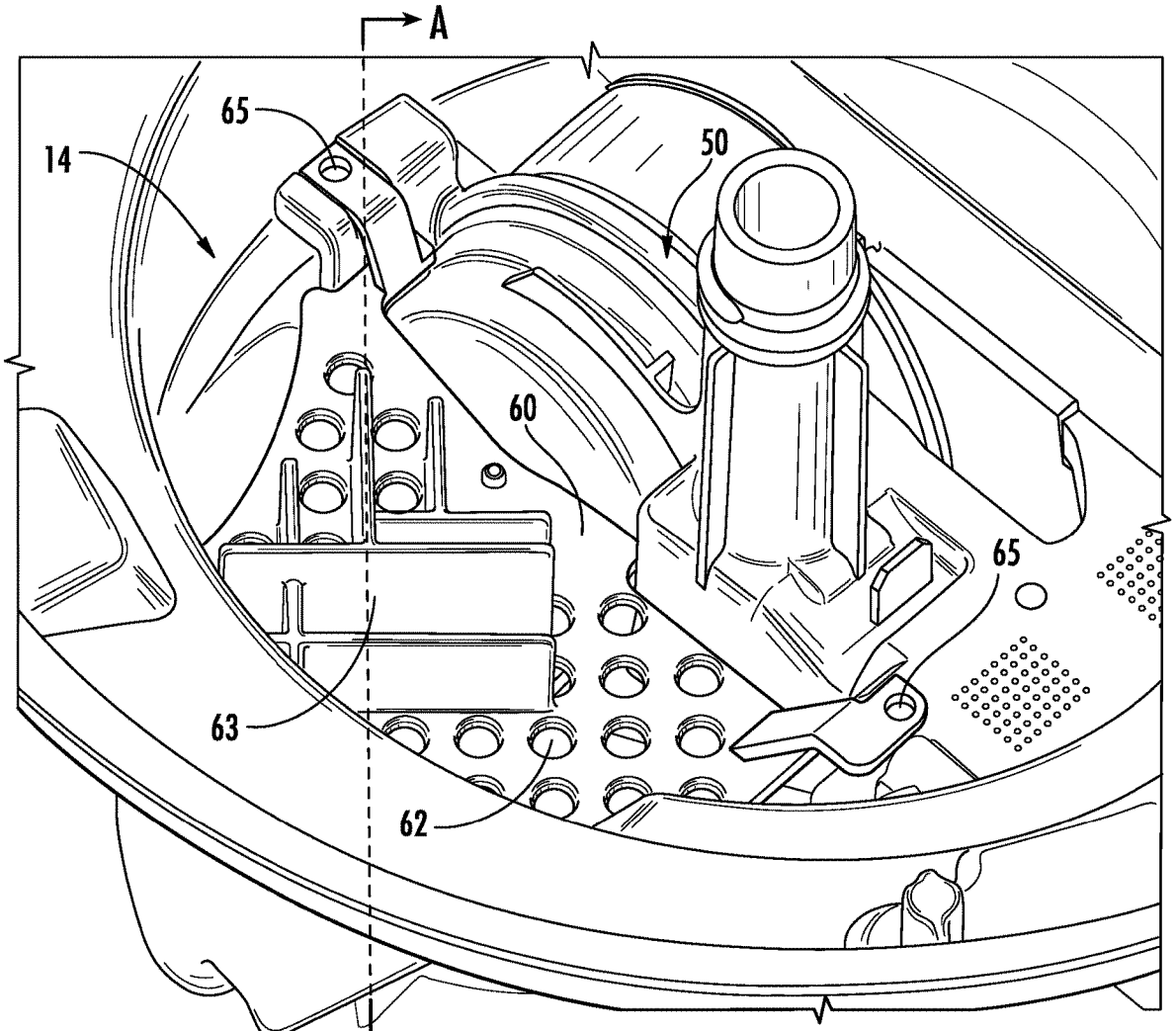
Figure 6:
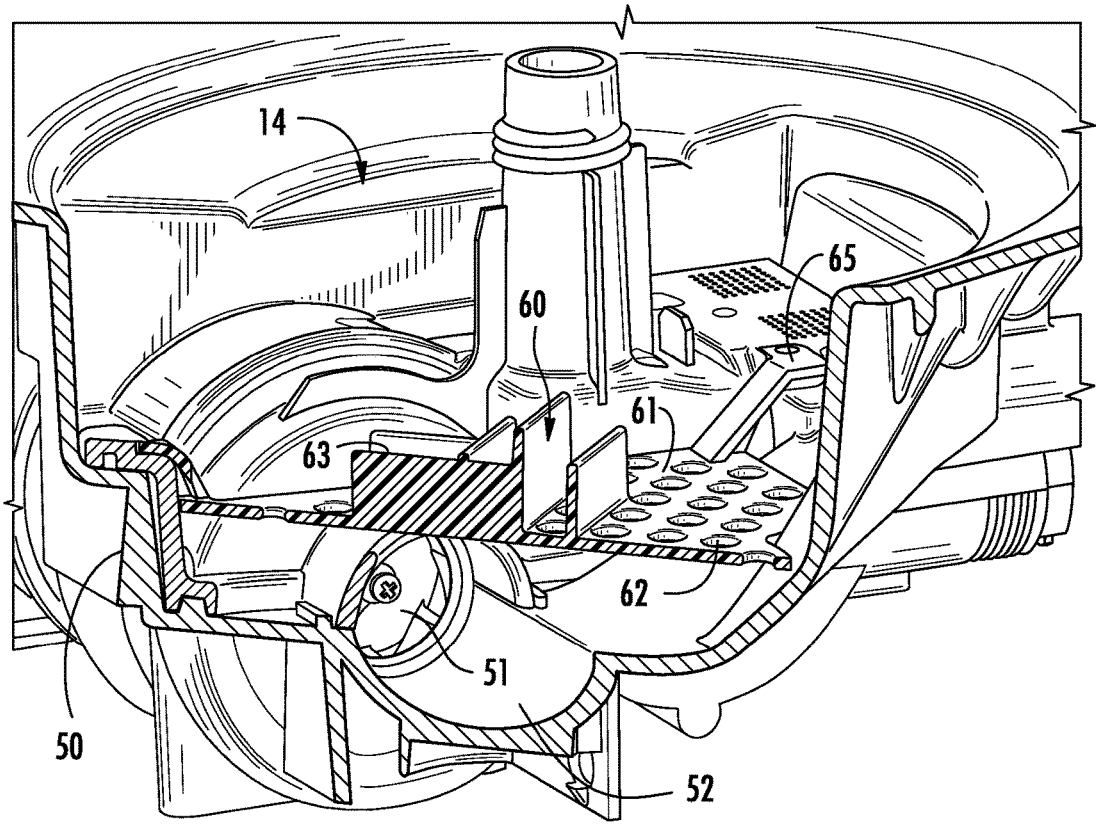
Figure 6A:
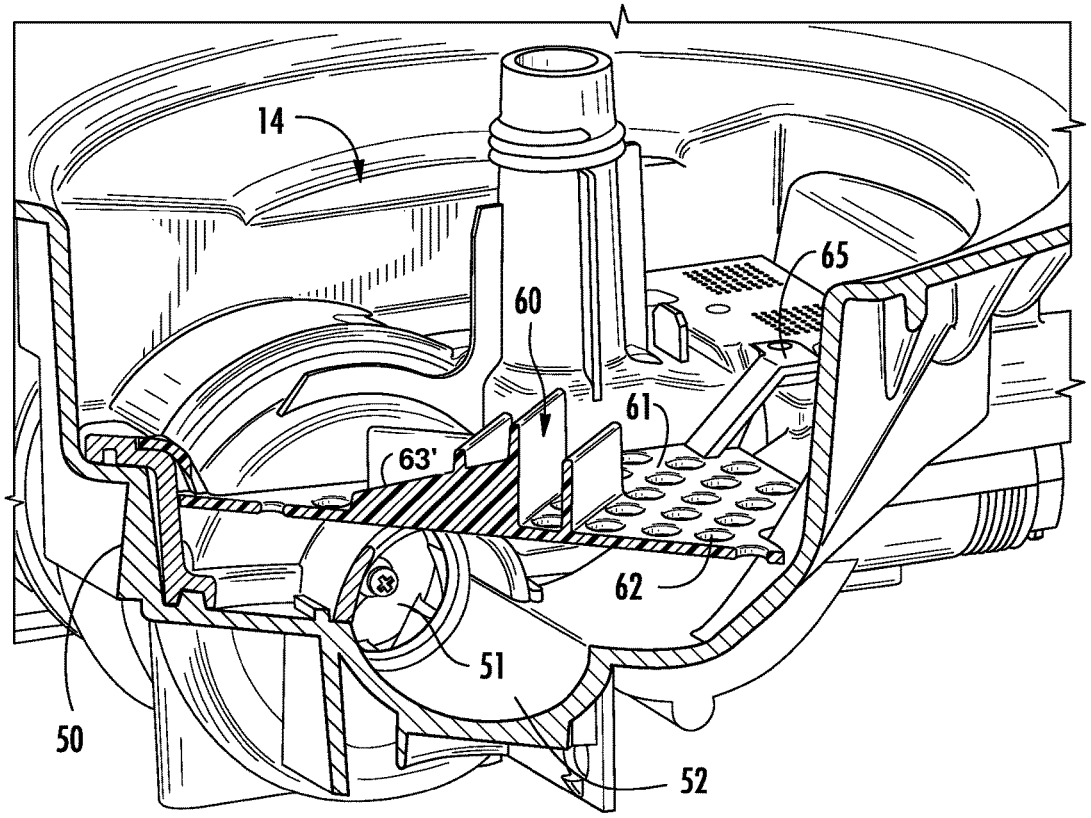
Figure 7:
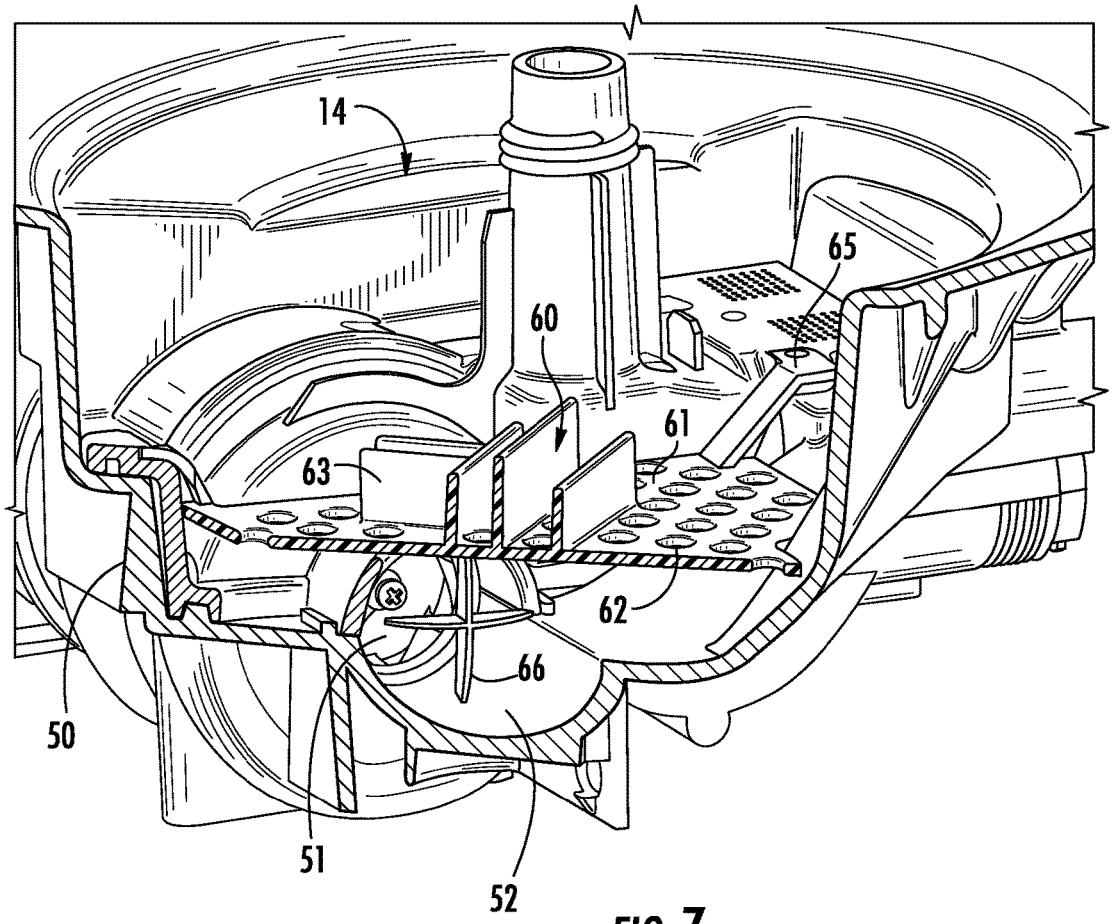

Having thus described the invention in general terms, reference will now be made to the accompanying drawings, which are not necessarily drawn to scale, and wherein:

FIG. 1 is a perspective view of a dishwasher, in accordance with some embodiments discussed herein;

FIG. 2 is a perspective view of an example sump, in accordance with some embodiments discussed herein;

FIG. 3 is a perspective view of an example pump plate for conditioning fluid flow preceding a circulation pump inlet, in accordance with some embodiments discussed herein;

FIG. 4 is perspective view of another example pump plate for conditioning fluid flow preceding a circulation pump inlet, in accordance with some embodiments discussed herein;

FIG. 5 is a perspective view of the pump plate shown in FIG. 3 installed in the sump shown in FIG. 2, in accordance with some embodiments discussed herein;

FIG. 6 is a cross-sectional view of the pump plate and sump shown in FIG. 5 taken along line AA of FIG. 5, in accordance with some embodiments discussed herein FIG. 6A is a cross-sectional view of another example pump plate installed in the sump shown in FIG. 5 taken along line AA of FIG. 5, in accordance with some embodiments discussed herein; and FIG. 7 is a cross-sectional view of the pump plate shown in FIG. 4 installed in the sump shown in FIG. 2, in accordance with some embodiments discussed herein.

DETAILED DESCRIPTION OF VARIOUS EMBODIMENTS

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

FIG. 1 illustrates an example of a dishwasher 10 capable of implementing various embodiments of the present invention. Such a dishwasher 10 typically includes a tub 12 (partly broken away in FIG. 1 to show internal details), having a plurality of walls (e.g., side wall 13) for forming an enclosure in which dishes, utensils, and other dishware may be placed for washing. As known in the art, the dishwasher 10 may also include slidable lower and upper racks (not shown) for holding the dishes, utensils, and dishware. A door 18 may be pivotably engaged with the tub 12 to selectively permit access to the interior of the tub 12. The door 18 may be configured to close in order to cover and seal the tub 12 when the dishwasher is in operation.

The tub 12 may include a sump 14 in which wash fluid or rinse fluid (herein collectively referred to as wash fluid) is collected, typically under the influence of gravity. The wash fluid may be pumped by a circulation pump 50 (such as through circulation conduit 26) to one or more spray arms (e.g., lower spray arm 20 and/or middle spray arm 25) mounted in the interior of the tub 12 for spraying the wash fluid, under pressure, onto the dishes, utensils, and other dishware contained therein.

The dishwasher 10 may also comprise a controller 40 that may be in communication with one or more of the operational components of the dishwasher 10. For example, the controller 40 may be in communication with the circulation pump 50 and may be configured to selectively operate the circulation pump 50 to pump wash fluid to at least one spray arm and/or spray jet. In some embodiments, the controller 40 may comprise a processor or other computing means such that operations can be performed in the dishwasher. Additionally or alternatively, the controller 40 may comprise a memory for storage of data such as routines for operation of the dishwasher 10. In some embodiments, the controller 40 may be housed in the lower end 22 of the dishwasher 10.

FIG. 2 illustrates an example sump 14 that may be used in the dishwasher 10 capable of implementing various embodiments of the present invention. The inlet 51 to the circulation pump 50 may be disposed in the sump 14. In the example sump 14 shown in FIG. 2, a flow inlet channel 52 for collecting wash fluid may precede the pump inlet 51. As further explanation, the illustrated circulation pump 50 includes the circulation pump body and the volute cover.

During normal operation of the dishwasher 10, the circulation pump 50 directs (e.g., pumps) wash fluid to one more spray arms 20, 25. For example, the circulation pump 50 may define an impeller (e.g., the closed vane impeller shown in FIG. 6) that draws in wash fluid by the creation of low pressure (e.g., suction). The circulation pump 50 creates an increase in pressure by transferring the mechanical energy from the motor of the circulation pump to the wash fluid through the rotating impeller. In such a manner, a high pressure gradient is created at the circulation pump outlet, which leads to fluid flow within the circulation system (e.g., spray arms 20, 25). The high pressure gradient drives the wash fluid from the circulation pump inlet to the circulation pump outlet. In particular, fluid is accelerated as it travels along the spinning impeller blades. The flow then enters a volute which has a larger cross sectional area and the velocity is converted to pressure. This pressure drives the fluid through the circulation system. Though the above description details a circulation pump with a closed vane impeller, some embodiments of the present invention contemplate use with a circulation pump with an open vane impeller.

The wash fluid then drips off of the dishes, utensils, other dishware, or racks or runs down the side walls 13 into the sump 14. In some embodiments, as the wash fluid collects in the sump 14, the wash fluid may pool in the flow inlet channel 52 and the remainder of the sump 14 for submerging the pump inlet 51 below a sufficient height of fluid so as to prevent air and/or vapor from being drawn into the circulation pump 50 during operation. The wash fluid in the flow inlet channel 52 then enters the circulation pump inlet 51 and is pumped through the one or more spray arms 20, 25 via the circulation pump 50. In some embodiments, the designed level of wash fluid for submerging the pump inlet 51 may be determined to be in excess of the minimum requirement to maintain a primed circulation pump and so include an added factor for safety. Additionally, in some embodiments, other factors may be considered for designing the level of wash fluid for submerging the pump inlet 51 (e.g., maintaining pressure conditions, rotation speed of the impeller of the circulation pump, general performance desires, etc.).

Though the depicted embodiment shows a circulation pump 50 that is directly mounted to the sump 14, some embodiments of the present invention contemplate use of a pump plate with a circulation pump that is indirectly mounted to a sump (e.g., the circulation pump body may be mounted external to the sump). For example, the indirectly mounted circulation pump may define an inlet hose and an outlet hose. The inlet hose may lead to the sump 14 and may be configured to receive the wash water from the sump 14 prior to entrance into the circulation pump. In this regard, in some embodiments, reference to the term circulation pump inlet may, in some embodiments, include the inlet hose. Likewise, reference to the area preceding the circulation pump inlet may, in some embodiments, refer to an area within the sump preceding the inlet hose of an indirectly mounted circulation pump.

The variety of surfaces the wash fluid may encounter after being sprayed out of the one or more spray arms 20, 25 tends to result in a fluid flow comprising a spectrum of angular momentum and linear momentum components. This spectrum of angular and linear momentum components carried by the wash fluid flowing from different parts of the tub 12 contributes to the overall flow of wash fluid within the dishwasher 10 being turbulent. Additionally, there are nearly an infinite number of ways to place dishware within the dishwasher 10. This results in the flow of the wash fluid into the sump 14 of the dishwasher 10 being turbulent and difficult to predict. The turbulence of the fluid flow causes the wash fluid to take longer to settle into a pool in the sump 14 and contributes to the creation of vortices that can pull air and/or vapor down into the pool, increasing the air and/or vapor being run through the circulation pump 50.

In the past, a large volume of wash fluid has been used to mitigate the effects of the turbulent flow of the wash fluid collecting in the sump 14. Using a large volume of wash fluid helps nullify the effects of the turbulent flow since a pool of wash fluid is created in the sump 14. In as much as this pool of wash fluid is large in comparison to the circulation pump 50 flow rate an increased residence time for the wash fluid will result. This increased amount of residence time allows for the turbulence in the flow to dissipate and also provides a still pool of fluid that acts as a damper to the incoming flow streams. The resultant, still pool does not resist the buoyant forces that naturally cause vapor to rise up through the surface of the pool. In this regard, the greater the fluid height above the pump inlet the greater the buoyant force available for driving out the vapor. The circulation pump 50 can then draw in the settled wash fluid available in the pool within the sump 14. In this way both entrained vapor and conflicting momentum within the pool in the sump 14 are removed from the inlet flow to the circulation pump 50. Further, the surface of the still pool is relatively smooth and of consistent height and so does not contribute to further vapor entrainment or to the creation of carry under causing vortices. However, if the volume of wash fluid is simply decreased then the portion of the fluid flow that has time to settle before being drawn into the circulation pump is decreased along with the height of fluid available for preventing carry under, for driving vapor up and out of the fluid and for preventing cavitation. The decreased wash fluid level at the pump 50 inlet 51 may not enable efficient or even effective pump operation. Thus, turbulent fluid flow, which may include a significant amount of air and/or vapor that has been entrained by any of a number of means or has been carried under by vortices that pull air from the volume over the wash fluid in the area preceding the inlet 51 may enter the inlet 51 of the circulation pump 50. Some embodiments of the present invention enable a reduced total amount of water to be used and still provides for mitigating the effects of the turbulent flow of the wash fluid collecting in the sump 14 to allow for efficient operation of the circulation pump 50.

In such a regard, some embodiments of the present invention provide a pump plate for conditioning a fluid flow preceding an inlet of a circulation pump of a dishwasher. As described in greater detail herein, the pump plate may be positioned within the sump of the dishwasher and configured to condition fluid flow so as to settle the wash fluid prior to entrance into the inlet of the circulation pump. Indeed, in some embodiments, the pump plate may define features (e.g., holes, upper guide vanes, lower guide vanes, etc.) that reduce turbulence generation in the wash fluid heading toward the inlet of the circulation pump. For example, in some embodiments, the pump plate may transition the wash fluid to become steadier and more stable such as to create a more laminar flow prior to entrance into the inlet of the circulation pump. Additionally, in some embodiments, the pump plate (such as through its various features) may be configured to reduce noise emanating from the dishwasher due to the conditioning and settling of the fluid flow.

With reference to FIGS. 5 and 6, an example pump plate 60 may be positioned within the sump 14 of a dishwasher. The position of the pump plate 60 (e.g., the height of the pump plate 60 with respect to the inlet 51 of the circulation pump 50) may be designed based on a number of factors, such as the height of the top of the inlet 51 of the circulation pump 50 and the anticipated fluid flow path within the sump and dishwasher. Though the pump plate 60 is shown such that the plate portion 61 of the pump plate 60 lies in a horizontal plane, some embodiments of the present invention contemplate positioning the pump plate such that the plate portion lies at any angle within the sump (e.g., the plate portion 61 may be tilted with respect to the inlet 51 of the circulation pump 50).

FIG. 3 shows an example pump plate 60 for conditioning a fluid flow preceding an inlet of a circulation pump of a dishwasher, according to various embodiments of the present invention. The pump plate 60 comprises a plate portion 61. In the embodiment illustrated in FIG. 3, the plate portion 61 is substantially planar. In various other embodiments, the plate portion 61 may define any shape (e.g., the plate portion may be convex, concave, stepped, curved, etc.). The plate portion 61 defines a first surface 611 and a second surface 612. In various embodiments, the first surface 611 may be an upper surface of the plate portion 61 and the second surface 612 may be a lower surface of the plate portion.

In some embodiments, the pump plate 60 may further comprise a plurality of holes 62 defined in the plate portion 61. The plurality of holes 62 may extend between the first and second surfaces 611, 612 of the plate portion 61. In various embodiments, each hole may define different characteristics, such as size (e.g., diameter size), shape (e.g., circular, square, hexagonal, etc.), and surface details. Along these lines, in some embodiments, at least one hole may define different edge characteristics. For example, in some embodiments, at least one of the plurality of holes may have a sharp edge in common with the first surface 611. In other embodiments, at least one of the plurality of holes may have a chamfered or radiused edge in common with the first surface 611. Further, in some embodiments, at least one of the plurality of holes may have a sharp edge in common with the second surface 612. In other embodiments, at least one of the plurality of holes may have a chamfered or radiused edge in common with the second surface 612. In some embodiments, the edge characteristics may be configured to influence the pressure drop of the fluid flowing through the hole and/or the direction of the fluid flow through the hole (and, thus, pump plate). Additionally, in some embodiments, the edge characteristics may be configured to breakdown vapor bubbles (e.g., the sharp edge may be configured to breakdown a vapor bubble that comes into contact with it).

In some embodiments, a hole defined in a pump plate may be positioned around the perimeter of the pump plate such that the profile of the hole is not completely enclosed. In this regard, in some embodiments, the pump plate may define one or more partial holes around its perimeter. Further, in some embodiments, the pump plate may be designed with a gap between the plate portion 61 and the surrounding sump 14, such as to effectively create a gap for the wash fluid to flow around the pump plate to the circulation pump inlet.

The plurality of holes 62 through the plate portion 61 may be configured to allow wash fluid to pass through the pump plate 60. In this regard, in some embodiments, the plurality of holes may be configured to condition the fluid flowing toward the circulation pump through the pump plate. Along these lines, in some embodiments, the plurality of holes may be configured to help break up air bubbles that form in the wash fluid heading toward the circulation pump inlet 51. In this regard, an air bubble larger than the hole could be forced to break down in order to pass through the hole, thereby making the smaller air bubbles that are easier to handle by the circulation pump. Along these lines, in some embodiments, the plurality of holes may be configured to condition the fluid flow through the pump plate, thereby reducing noise that is created as the wash fluid heads toward the circulation pump.

In various embodiments, the plurality of holes 62 may be uniform in size. Alternatively, the plurality of holes 62 may define a variety of different size holes. In various embodiments, the plurality of holes may be uniformly distributed over plate portion 61 or, in some cases, at least uniformly distributed over at least a portion of the plate portion 61. In other embodiments, at least a portion of the plurality of holes 62 may be clustered in a region of the plate portion 61 and more sparsely distributed over other regions of the plate portion 61. In various embodiments, the plurality of holes 62 may pass straight through the plate portion 61. In such embodiments, the axis of the hole may be perpendicular to the plate portion 61. In other embodiments, one or more of the plurality of holes 62 may pass through the plate portion 61 at an angle such that the axis of the hole is not perpendicular to the plate portion. This may be advantageous, for example, in directing the fluid flow more towards the pump inlet.

In some embodiments, variables concerning the holes (e.g., the number of holes, the size of the holes, the location of the holes on the pump plate, and/or the axis of the holes) may be determined based on the desired effect on the fluid flow within the dishwasher tub preceding the inlet of the circulation pump. For example, such variables may be determined to allow a maximum fluid volume to transfer through the pump plate with the least amount of pressure loss. In such a regard, the maximum fluid volume may be available immediately to the inlet of the circulation pump with a path of least resistance. In another example embodiment, the variables concerning the holes may be determined based on the desire to achieve a uniform velocity profile across the surface (e.g., the plate portion 61) defined by the pump plate 60 so as not to encourage the formation of a vortex. In still another example embodiment, the variables concerning the holes may be determined based on the resultant shear force that can be created to break down larger vapor bubbles.

Remaining with FIG. 3, the pump plate 60 may further comprise at least one upper guide vane 63 extending outwardly from the first surface 611 of the plate portion 61. In some embodiments, the pump plate 60 may comprise at least one first upper guide vane 631 extending outwardly from the first surface 611 of the plate portion 61 and at least one second upper guide vane 632 extending outwardly from the first surface 611 of the plate portion 61 and intersecting with the at least one first upper guide vane 631. In some embodiments, the at least one first upper guide may intersect with at least one second upper guide vane at an approximately 90 degree angle (e.g., the first upper guide vane may be perpendicular to the second upper guide vane). With reference to FIG. 3, in some embodiments, the first upper guide vane extends up to (and not past) a second upper guide vane (see e.g., the intersection of first upper guide vane 631 and second upper guide vane 632). In some embodiments, such a configuration is considered to be "intersecting," as the term "intersecting" is not meant to be limited to upper guide vanes extending past each other (see e.g., the intersection of first upper guide vane 633 and second upper guide vane 634). In various embodiments, the at least one upper guide vane 63 may be configured to destroy and/or prevent the formation of vortices within the fluid flow. In various embodiments, the at least one upper guide vane may also be configured to impart a desired direction to the fluid flow.

In various embodiments, the pump plate 60 may comprise a plurality of first and/or second upper guide vanes 63. In various embodiments, at least some of the upper guide vanes 63 may extend outwardly from the plate portion 61 at different heights. For example, in the embodiment shown in FIG. 3, upper guide vanes 631 and 632 are taller than upper guide vanes 633, 634, 635, and 636. Further, in some embodiments, at least some of the upper guide vanes may each define varying heights by themselves. For example, with reference to FIG. 6A, the upper guide vane 63' defines a height that tapers (e.g., from generally the center of the pump plate 60 to the perimeter). In various embodiments, at least some of the upper guide vanes 63 may extend along the plate portion to define different lengths. For example, in the embodiment shown in FIG. 3, upper guide vanes 631 and 633 are longer than upper guide vanes 632, 634, 635, and 636. In various embodiments, the use of different heights, varying heights, and/or different lengths of the upper guide vanes 63 may enable efficient destruction and/or prevention of the formation of vortices within the fluid flow. Indeed, in some embodiments, the different heights, varying heights, and/or different lengths of the upper guide vanes may enable a tiered approach to destruction and/or prevention of the formation of vortices such that the turbulent fluid flow more rapidly settles.

In some embodiments, the height of each upper guide vane may be designed based on the anticipated fluid flow inside the dishwasher tub and sump. In this regard, the tallest upper guide vane may, in some embodiments, be located on the pump plate in a position that corresponds to the anticipated location of a primary vortex within the fluid flow. In this regard, the tallest upper guide vane may be designed and specifically located so as to destroy and/or prevent formation of the primary vortex within the fluid flow. Additionally, in some embodiments, additional (e.g., secondary) upper guide vanes of lesser height may be located on the pump plate extending outwardly from the tallest upper guide vane. Such secondary upper guide vanes may be designed and specifically located so as to destroy and/or prevent formation of secondary vortices that are anticipated to form upon destruction of the primary vortex by the tallest upper guide vane. In such a manner, in some embodiments, the pump plate can be designed to counteract anticipated turbulence within the fluid flow for the specific dishwasher in which it is being used. Likewise, the varying height and/or length of each upper guide vane may be designed based on the anticipated fluid flow inside the dishwasher tub and sump so as to counteract anticipated turbulence within the fluid flow for the specific dishwasher in which it is being used. Likewise, the varying height and/or length of each upper guide vane may be based on a desire to limit flow restriction and pressure drop.

For example, with reference to FIG. 3, the pump plate 60 includes a tallest first upper guide vane 631 that is specifically located (e.g., in the center of the area preceding the circulation pump inlet 51, which is shown in FIG. 6). Additionally, the pump plate 60 includes secondary first upper guide vanes 633 and 635 that each extend upward at a shorter height than the tallest first upper guide vane 631 and are each located on the pump plate 60 outwardly from the location of the tallest first upper guide vane 631. Similarly, the pump plate 60 includes a similar configuration for the second upper guide vanes (e.g., a tallest second upper guide vane 632 and secondary second upper guide vanes 634 and 636). Further, as shown in FIG. 3, in some embodiments, the configuration in height, length, or location of the first and/or second upper guide vanes may be symmetrical on the pump plate.

The example pump plate 60 shown in FIG. 3 includes just one example of a configuration of height, length, and location for the first and second upper guide vanes. In such a regard, some embodiments of the present invention contemplate any type of configuration such that the pump plate may be designed with first and/or second upper guide vanes that define varying or different heights, lengths, or locations. For example, the upper guide vanes may define different heights from each other. Additionally or alternatively, the location of each upper guide vane may vary. Further, the number of first and/or second upper guide vanes may also vary. Along these lines, in some embodiments, the configuration in height, length, or location of the first and/or second upper guide vanes may be asymmetrical on the pump plate. In such a regard, the illustrated example pump plate 60 is not meant to be limiting and is provided as an example of how a pump plate contemplated by the present invention may be designed to counteract and settle the fluid flow of a specific dishwasher (e.g., with specific components and a specific anticipated fluid flow within the tub and sump).

In various embodiments, the at least one upper guide vane 63 extends outwardly from the plate portion 61, such that the angle between the plate portion 61 and each upper guide vane 63 is greater than about 0 degrees and less than or equal to about 90 degrees. In various embodiments, the at least one upper guide vane 63 may be perpendicular to the first surface 611 of the plate portion 61. In various embodiments in which the upper guide vane 63 is perpendicular to the plate portion 61, the upper guide vane 63 may provide a larger surface area for momentum dissipating collisions with various portions of the turbulent fluid flow, allowing the upper guide vane 63 to more efficiently dissipate various components of angular or linear momentum within the fluid flow. In some embodiments, the at least one upper guide vane 63 may extend from the first surface of the plate portion 61 at an angle other than 90 degrees (e.g., 35 degrees, 45 degrees, etc.). For example, in some embodiments, the at least one upper guide vane may be tilted relative to the plate portion 61. In such embodiments, the at least one upper guide vane may be tilted so as to direct the fluid flow into the plate portion 61 (e.g., toward at least one of the plurality of holes positioned on the plate portion 61) such that the fluid flows more rapidly through the plate portion 61 toward the inlet 51 of the circulation pump 50.

In various embodiments, wherein the pump plate 60 comprises a plurality of first guide vanes 631 and/or a plurality of second guide vanes 632, two first upper guide vanes 631, 635 may be spaced apart from each other and each intersect with one second upper guide vane 632 (or one first upper guide vane 631 and two second upper guide vanes 632, 634) to define a channel 64. For example, in the embodiment shown in FIG. 3, first upper guide vanes 631 and 635 and second upper guide vane 632 define a channel 64. In various embodiments, the channel 64 may be configured to align with at least one of the plurality of holes 62. Thus, a portion of the fluid flow may enter the channel 64 and interact with upper guide vanes 631, 632, and/or 635. By interacting with upper guide vanes 631, 632, and/or 635, the portion of the fluid flow flowing into the channel 64 may dissipate angular and/or linear momentum in one or more directions, allowing that portion of the fluid flow to pass through the at least one of the plurality of holes 62 aligned with the channel 64. As described in greater detail herein, in some embodiments, the upper guide vanes may be configured to interact with the fluid flowing toward the circulation pump to destroy and/or prevent formation of vortices therein. In this regard, an upper guide vane may break down a large vortex into smaller vortices. Further, in some embodiments, additional upper guide vanes may then further break down the now smaller vortices, thereby conditioning the fluid flow prior to passing through the pump plate and ultimately into the circulation pump.

Additionally, in various embodiments, the channel 64 is configured such that the channel is not closed. For example, the channel 64 may be defined by only three upper guide vanes (e.g., upper guide vanes 631, 635, and 632), allowing wash fluid flowing along the first surface 611 of the plate portion 61 to flow into the channel 64. Indeed, in some embodiments, if a channel is configured such that the channel is closed, the closed channel may encourage the formation of a vortex and thereby increase the amount of air and/or vapor that is passed into the circulation pump 50.

In various embodiments, a plurality of first and/or second upper guide vanes 63 may intersect to form a plurality of channels 64, wherein each channel is configured to align with at least one of the plurality of holes 62. Each channel 64 may be configured to dissipate angular and/or linear momentum of a portion of the fluid flow that flows into the channel 64, allowing that portion of the fluid flow to pass through the at least one of the plurality of holes 62 aligned with that channel 64. By including multiple channels 64, the pump plate 60 may condition the flow of fluid in the dishwasher 10 more efficiently.

In some embodiments, the pump plate 60 may further comprise at least one attachment feature 65. The attachment feature 65 may be a projection with an opening for securement within the dishwasher. In various embodiments, the attachment feature 65 may be used to secure the pump plate 60 within the dishwasher 10. For example, the at least one attachment feature 65 may be configured to secure the pump plate 60 into the sump 14 of the dishwasher 10. In various embodiments, such as the embodiment shown in FIG. 5, the at least one attachment feature 65 may be configured to attach to a portion of the dishwasher 10 to secure the pump plate 60 within the dishwasher 10 such that the pump plate 60 fluidly-encloses an area preceding the inlet 51 of the circulation pump 50 such that the fluid within the dishwasher 10 flows through the pump plate 60 prior to entering the inlet 51 of the circulation pump 50. In various embodiments in which the area preceding the inlet 51 of the circulation pump 50, including, for example, the flow inlet channel 52, is fluidly-enclosed by the pump plate 60, all or most of the fluid flow entering flow inlet channel 52 may be conditioned by the pump plate 60. Therefore, after interacting with the pump plate 60, the turbulence in the fluid flow may be significantly dissipated prior to entrance into the area preceding the circulation pump inlet 51.

In various embodiments, a pump plate may further comprise at least one lower guide vane. As shown in FIG. 4, in some embodiments, the pump plate 60 may comprise a plurality of lower guide vanes 66. For example, the lower guide vanes 66 may comprise a first lower guide vane 661 extending outwardly from the second surface of the plate portion 61. The first lower guide vane 661 may define a first side and a second side. In various embodiments, the lower guide vanes 66 may further comprise a second lower guide vane 662 extending outwardly from the first side and the second side of the first lower guide vane 661 such that the second lower guide vane 662 extends in a plane that is perpendicular to the first lower guide vane 661 and parallel to the plate portion 61. Thus, in various embodiments, the lower guide vanes 66 may appear as a "+"-shaped appendage extending outwardly from the second surface of the plate portion 61. In some embodiments, with reference to FIG. 7, the lower guide vanes 66 may be configured to align with the circulation pump inlet 51. The lower guide vanes 66 may be configured to further condition the fluid flow before the fluid flow enters the inlet 51 to the circulation pump 50. For example, the lower guide vanes 66 may be configured to further dissipate any linear or angular momentum components remaining in the fluid flow that are not parallel to the axis of the inlet 51. Though the example embodiment of the lower guide vanes 66 described above intersect perpendicularly to define a "+"-shaped appendage, some embodiments of the present invention contemplate any configuration and/or shape of lower guide vanes that extend from the plate portion of the pump plate (e.g., the lower guide vanes may each extend outwardly from the plate portion, the lower guide vanes may intersect at a different angle, more than two lower guide vanes may be used, etc.).

In various embodiments, a pump plate 60 may be molded as a single component. For example, a pump plate 60 comprising a plate portion 61, a plurality of holes 62, at least one upper guide vane 63, and at least one attachment feature 65 may be integrally molded. In another example, a pump plate 60 comprising a plate portion 61, a plurality of holes 62, a plurality of upper guide vanes 63, at least one channel 64, and at least one attachment feature 65 may be integrally molded. In yet another example, a pump plate 60 comprising a plate portion 61, a plurality of holes 62, at least one upper guide vane 63, lower guide vanes 66, and at least one attachment feature 65 may be integrally molded. Thus, in such embodiments, a pump plate 60 may be manufactured easily and inexpensively. Moreover, in such embodiments, a pump plate 60 may be easily installed in a dishwasher 10 and, as the pump plate 60 comprises only one piece, may require minimal maintenance. In various embodiments, a pump plate 60 may be molded out of plastic or constructed of some other appropriate material.

Reference will now be made to FIGS. 5, 6, and 7. FIGS. 5-7 illustrate various embodiments of an example pump plate 60 positioned within an example sump 14 of a dishwasher 10. In various embodiments, the pump plate 60 may be secured in a dishwasher 10, possibly via the at least one attachment device 65, such that the pump plate 60 fluidly encloses an area preceding the inlet 51 of the circulation pump 50 such that fluid within the dishwasher flows through the pump plate 60 prior to entering the inlet 51 of the circulation pump 50.

As previously described herein, the unconditioned flow of wash fluid into the sump 14 of a dishwasher may comprise a spectrum of angular momentum and linear momentum components. In some embodiments, the various momentums should be dissipated for the wash fluid to settle into the flow inlet channel 52 to efficiently feed the circulation pump 50 through inlet 51. Indeed, as the wash fluid runs down the dishwasher tub into the sump 14, vortices may be created that can cause air and/or vapor to be pulled into the flow of wash fluid. This occurrence can be referred to as carry under and it reduces the efficiency of the circulation pump 50. The pump plate 60 may act to reduce the turbulence in the flow of wash fluid before the wash fluid reaches the inlet 51, therefore providing a consistent supply of wash fluid to the circulation pump 50 while minimizing and/or reducing carry under.

In some embodiments, the pump plate 60 comprises a plurality of holes 62. In various embodiments wherein the pump plate 60 fluidly-encloses an area preceding the inlet 51, the wash fluid may pass through the plurality of holes 62 to reach the flow inlet channel 52 and/or the inlet 51. As the wash fluid reaches the pump plate 60, portions of the fluid flow with a linear momentum having a significant downward component may pass through at least one of the plurality of holes 62. However, a majority of portions of the fluid flow with significant momentum components in a direction other than downward, may travel across the first surface 611 of the pump plate 60, colliding with other portions of the fluid flow or components of the dishwasher (e.g., the walls of the sump 14 or the like). These collisions may act to dissipate various momentums within the fluid flow. As the non-downward momentum components in various portions of the fluid flow are reduced, those portions of the fluid flow may pass through at least one of the plurality of holes 62.

In some embodiments, the size of the plurality of holes 62 may offer some control over the maximum and/or average non-downward momentum that a portion of the fluid flow may have and still pass through at least one of the plurality of holes 62. For example, the maximum and/or average non-downward momentum component of a portion of the fluid flow passing through a plurality of holes with a smaller diameter may be less than the maximum and/or average non-downward momentum component of a portion of the fluid flow passing through a plurality of holes with a larger diameter. However, in some embodiments, it may be beneficial to define the diameter of each of the plurality of holes 62 to be large enough in size to allow a sufficient flow rate of wash fluid through the pump plate 60 to feed the circulation pump 50. Additionally or alternatively, in some embodiments, it may be beneficial to define a certain number of holes with the plate portion to allow a sufficient flow rate of wash fluid through the pump plate 60 to feed the circulation pump 50.

In various embodiments, the ratio of the combined surface area of the plurality of holes 62 to the surface area of the inlet 51 may be configured to minimize the maximum and/or average non-downward momentum components of the portions of the fluid flow passing through the plurality of holes 62 while still allowing a sufficient flow rate of wash fluid through the pump plate 60. In some embodiments, the ratio of the combined surface area of the plurality of holes 62 to the surface area of the inlet 51 is about 1.7.

The pump plate 60 may further comprise at least one upper guide vane 63. In various embodiments, the at least one upper guide vane 63 may be configured to dissipate momentum components of the fluid flow and destroy and/or prevent formation of vortices in the flow of wash fluid. In various embodiments, portions of the fluid flow carrying angular and/or linear momentum may collide with the at least one upper guide vane 63. The collision between the fluid flow and the at least one upper guide vane 63 may cause dissipation of angular and/or linear momentum within the fluid flow. By reducing the angular momentum carried by the wash fluid, the upper guide vanes 63 may destroy and/or prevent formation of vortices within the fluid flow and reduce carry under within the fluid flow, thereby reducing the amount of air and/or vapor entering the pump inlet 51. Thus, the at least one upper guide vane 63 may increase the efficiency of the circulation pump 50.

In various embodiments, the pump plate 60 may comprise at least one first upper guide vane 631 and at least one second upper guide vane 632. As described above, one or more first upper guide vanes 631 and one or more second upper guide vanes 632 (e.g., first upper guide vanes 631 and 635 and second upper guide vane 632), may define a channel 64. At least one of the plurality of holes 62 may be aligned with the channel 64. In various embodiments, as the fluid flow travels across the pump plate 60, a portion of the fluid flow may flow into the channel 64. Eventually, a portion of the fluid flow flowing into the channel 64 may collide with at least one of the upper guide vanes 63 (e.g., 631, 632, and/or 635) that define the channel 64, causing the portion of the fluid flow to dissipate at least some of the angular and/or linear momentum carried by that portion of the fluid flow. When the angular and/or linear momentum of the portion of the fluid flow is sufficiently depleted, the portion of the fluid flow may pass through the at least one of the plurality of holes 62 aligned with the channel 64. Thus, in various embodiments, a channel 64 may cause at least a portion of the fluid flow to dissipate angular and/or linear momentum and may direct that portion of the fluid flow to pass through the at least one of the plurality of holes 62.

As noted herein, in some embodiments, the pump plate 60 may be configured to reduce the linear and/or angular momentum carried by wash fluid collecting in the area preceding the inlet 51 of the circulation pump 50 (e.g., the flow inlet channel 52). By calming the flow of wash fluid before the wash fluid reaches the flow inlet channel 52, an overall reduction in water may be achieved while still maintaining efficient use of the circulation pump 50. Indeed, in some embodiments, the volume of water used by dishwasher 10 to complete a wash or rinse cycle may be reduced by the use of pump plate 60 to condition the flow of wash fluid because the wash fluid collects in the flow inlet channel 52 preceding the inlet 51 of the circulation pump 50 in an improved state. By providing the circulation pump 50 with a consistent, conditioned flow of wash fluid, a pump plate 60 may allow the circulation pump 50 to function efficiently while reducing the volume of water needed by dishwasher 10 to complete a wash or rinse cycle.

In various embodiments, with reference to FIG. 7, the flow of wash fluid into the inlet 51 of the circulation pump 50 may be further conditioned through the use of a pump plate 60 comprising lower guide vanes 66. The lower guide vanes 66 may be suspended below the pump plate 60 and precede the inlet 51 of the circulation pump 50. Thus, in such embodiments, at least a portion of wash fluid may pass through the lower guide vanes 66 before entering the inlet 51 of the circulation pump 50. In various such embodiments, the lower guide vanes 66 may act to further straighten the flow of wash fluid entering the circulation pump inlet 51. For example, if at least a portion of the flow of wash fluid comprises an angular momentum component, the portion of wash fluid may collide with at least one of the lower guide vanes 66 before entering the pump inlet. The collision of the portion of the fluid flow with at least one of the lower guide vanes 66 may reduce the amount of angular momentum carried by the portion of the fluid flow. Thus, in various embodiments of a pump plate 60 comprising lower guide vanes 66, the lower guide vanes 66 may be configured to further reduce the angular momentum carried by the flow of wash fluid as the flow of wash fluid approaches the circulation pump inlet 51. As such, the lower guide vanes 66 may allow the pump plate 60 to further condition the flow of wash fluid entering the circulation pump 50 via inlet 51. Therefore, in some embodiments, a dishwasher 10 comprising a pump plate 60 comprising lower guide vanes 66 may require a smaller volume of water to complete a wash or rinse cycle than a dishwasher not comprising a pump plate while maintaining efficient functioning of the circulation pump 50 due to the consistent, conditioned flow of wash fluid with a minimized volume of air and/or vapor entrained within the fluid flow provided to the circulation pump 50 via inlet 51.

Remaining with FIGS. 5, 6, and 7, a method for manufacturing a dishwasher comprising a pump plate 60 shall now be described. In various embodiments, the method of manufacturing may comprise providing a pump plate 60. In various such embodiments, pump plate 60 may comprise a plate portion 61 defining a first surface 611 and a second surface 612. A plurality of holes 62 may be defined in the plate portion and may extend between the first surface 611 and the second surface 612. The plurality of holes may be dispersed across the plate portion and configured to allow fluid to pass through the plate portion 61. The pump plate 60 may further comprise at least one upper guide vane 63 extending outwardly from the first surface 611. In various embodiments, the at least one upper guide vane 63 may comprise at least one first upper guide vane 631 extending outwardly from the first surface 611 and at least one second upper guide vane 632 extending outwardly from the first surface 611 and perpendicular to the at least one first upper guide vane 631.

In various embodiments, the pump plate 60 may be secured within the dishwasher 10. In such a regard, in some embodiments, the method of manufacturing may comprise securing the pump plate within a dishwasher. For example, in some embodiments, the pump plate 60 may comprise at least one attachment feature 65 that may be used to secure the pump plate within the dishwasher 10. In some embodiments, the pump plate 60 may be secured within the sump 14 of dishwasher 10. In various embodiments, the pump plate 60 may be secured within the dishwasher 10 to fluidly-enclose an area preceding the inlet 51 of the circulation pump 50 such that fluid within the dishwasher flows through the pump plate prior to entering the inlet of the circulation pump. As noted above, in some embodiments, the pump plate 60 may be specifically designed to include a gap between the perimeter of the pump plate 60 and the surrounding surfaces of the sump to enable fluid to flow around the pump plate (and, in some cases, act in similar fashion to a hole in the pump plate). In various embodiments, the pump plate 60 may be secured within dishwasher 10 in a factory setting. In other embodiments, the pump plate 60 may be secured within dishwasher 10 in a warehouse or retail store setting. In still other embodiments, the pump plate 60 may be secured within the dishwasher 10 in a residential or commercial setting where the dishwasher may be used.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included herein. Although specific terms are employed herein, they are used in a generic and descriptive sense only and not for purposes of limitation.

The invention claimed is:

1. A pump plate for conditioning fluid flow preceding an inlet of a circulation pump of a dishwasher, the pump plate comprising:

a plate portion defining a first surface and a second surface;

a plurality of holes defined in the plate portion and extending between the first surface and the second surface, wherein the plurality of holes are dispersed across the plate portion and configured to allow fluid to pass through the plate portion;

a plurality of first upper guide vanes extending outwardly from the first surface, each of the plurality of first upper guide vanes (a) extending along a portion of the first surface of the plate portion and (b) being parallel to another of the plurality of first upper guide vanes; and at least one second upper guide vane extending outwardly from the first surface, wherein the at least one second upper guide vane intersects with at least one first upper guide vane of the plurality of first upper guide vanes.

2. The pump plate of claim 1 further comprising:

a first lower guide vane extending outwardly from the second surface, wherein the first lower guide vane defines a first side and a second side; and a second lower guide vane extending outwardly from the first side and the second side of the first lower guide vane, wherein the second lower guide vane extends in a plane that is transverse to the first lower guide vane.

3. The pump plate of claim 2, wherein the first lower guide vane and the second lower guide vane form one of an x shape, a lowercase t shape, or an uppercase T shape.

4. The pump plate of claim 1, wherein the at least one first upper guide vane is perpendicular to the at least one second upper guide vane.

5. The pump plate of claim 1, wherein at least two of the plurality of first upper guide vanes extend outwardly from the plate portion at different heights.

6. The pump plate of claim 5, wherein at least one of the plurality of first upper guide vanes defines a height taller than the remaining of the plurality of first upper guide vanes and is located on the plate portion between at least two other of the plurality of first upper guide vanes.

7. The pump plate of claim 6, wherein the plurality of first upper guide vanes each define heights and are positioned on the plate portion so as to define a symmetrical configuration.

8. The pump plate of claim 1, wherein at least two of the plurality of first upper guide vanes extend along the plate portion to define different lengths.

9. The pump plate of claim 1, wherein the at least one first upper guide vane and the at least one second upper guide vane are perpendicular to the first surface.

10. The pump plate of claim 1, wherein the at least one second upper guide vane comprises a plurality of second upper guide vanes.

11. The pump plate of claim 1 wherein two of the plurality of first upper guide vanes are spaced apart and each intersect with one of the second upper guide vanes to form a channel, wherein the channel is configured to align with at least one of the plurality of holes defined in the plate portion such that fluid is conditioned to flow through the channel and the at least one of the plurality of holes aligned with the channel.

12. The pump plate of claim 11, wherein the plurality of first upper guide vanes and the plurality of second upper guide vanes intersect to form a plurality of channels, wherein each channel is configured to align with at least one of the plurality of holes defined in the plate portion such that fluid is conditioned to flow through the channel and the at least one of the plurality of holes aligned with the channel.

13. The pump plate of claim 1, wherein at least two of the plurality of holes define different diameters.

14. The pump plate of claim 1, wherein at least one of the plurality of holes defines a circular shape.

15. The pump plate of claim 1, wherein at least one of the plurality of holes is positioned along an edge of the pump plate.

16. The pump plate of claim 1, wherein at least one of the plurality of holes defines a sharp edge on the first surface of the plate portion.

17. The pump plate of claim 1 further comprising at least one attachment feature, wherein the at least one attachment feature is configured to attach to a portion of the dishwasher to secure the pump plate within the dishwasher to fluidly-enclose an area preceding the inlet of the circulation pump such that fluid within the dishwasher flows through the pump plate prior to entering the inlet of the circulation pump.

18. The pump plate of claim 17, wherein the pump plate is configured such that a gap remains between the sump and an edge of the pump plate when the pump plate is secured within the dishwasher.

19. The pump plate of claim 1, wherein the pump plate is configured to reduce turbulence and/or break down vapor bubbles within the fluid flow of wash fluid preceding the inlet of the circulation pump.

20. The pump plate of claim 1, wherein the at least one first upper guide vane is configured to destroy and/or prevent formation of vortices within the fluid flow of wash fluid preceding the inlet of the circulation pump.

21. A pump plate for conditioning fluid flow preceding an inlet of a circulation pump of a dishwasher, the pump plate comprising:

a plate portion defining a first surface and a second surface;

a plurality of holes defined in the plate portion and extending between the first surface and the second surface, wherein the plurality of holes are dispersed across the plate portion and configured to allow fluid to pass through the plate portion;

a plurality of first upper guide vanes extending outwardly from the first surface, each of the plurality of first upper guide vanes (a) extending along a portion of the first surface of the plate portion and (b) being parallel to another of the plurality of first upper guide vanes; and a plurality of second upper guide vanes extending outwardly from the first surface, each of the plurality of second upper guide vanes (a) extending along a portion of the first surface of the plate portion and (b) being parallel to another of the plurality of second upper guide vanes wherein at least two of the plurality of first upper guide vanes and the plurality of second upper guide vanes extend outwardly from the plate portion at different heights.

22. The pump plate of claim 21 further comprising:

a first lower guide vane extending outwardly from the second surface, wherein the first lower guide vane defines a first side and a second side; and a second lower guide vane extending outwardly from the first side and the second side of the first lower guide vane, wherein the second lower guide vane extends in a plane that is perpendicular to the first lower guide vane and parallel to the plate portion.

23. The pump plate of claim 21, wherein at least one of the plurality of first upper guide vanes defines a height taller than the remaining of the plurality of first upper guide vanes and is located on the plate portion between at least two other of the plurality of first upper guide vanes.

24. The pump plate of claim 21, wherein the plurality of first upper guide vanes each define heights and are positioned on the plate portion so as to define a symmetrical configuration.

25. The pump plate of claim 21, wherein at least two of the plurality of first upper guide vanes extend along the plate portion to define different lengths.

26. The pump plate of claim 21, wherein at least one of the first upper guide vanes defines a tapered height.

27. A dishwasher comprising:

a sump;

a circulation pump having an inlet disposed in the sump; and a pump plate for conditioning fluid flow preceding the inlet of the circulation pump, the pump plate comprising:

a plate portion defining a first surface and a second surface;

a plurality of holes defined in the plate portion and extending between the first surface and the second surface, wherein the plurality of holes are dispersed across the plate portion and configured to allow fluid to pass through plate portion;

a plurality of first upper guide vanes extending outwardly from the first surface, each of the plurality of first upper guide vanes (a) extending along a portion of the first surface of the plate portion and (b) being parallel to another of the plurality of first upper guide vanes;

at least one second upper guide vane extending outwardly from the first surface, wherein the at least one second upper guide vane intersects with at least one first upper guide vane of the plurality of first upper guide vanes; and at least one attachment feature, wherein the attachment feature is configured to attach to a portion of the dishwasher to secure the pump plate within the dishwasher; and wherein the pump plate is secured within the dishwasher via the at least one attachment feature such that the pump plate fluidly encloses an area preceding the inlet of the circulation pump such that fluid within the dishwasher flows through the pump plate prior to entering the inlet of the circulation pump.

28. The dishwasher of claim 27 wherein the pump plate further comprises:

a first lower guide vane extending outwardly from the second surface, wherein the first lower guide vane defines a first side and a second side; and a second lower guide vane extending outwardly from the first side and the second side of the first lower guide vane, wherein the second lower guide vane extends in a plane that is perpendicular to the first lower guide vane and parallel to the plate portion.

29. The dishwasher of claim 27, wherein at least two of the plurality of first upper guide vanes extend outwardly from the plate portion at different heights.

30. The dishwasher of claim 27, wherein at least two of the plurality of first upper guide vanes extend along the plate portion to define different lengths.

31. The dishwasher of claim 27, wherein two of the plurality of first upper guide vanes are spaced apart and each intersect with one of the second upper guide vanes to form a channel, wherein the channel is configured to align with at least one of the plurality of holes defined in the plate portion such that fluid is conditioned to flow through the channel and the at least one of the plurality of holes aligned with the channel.

32. The dishwasher of claim 27, wherein the pump plate is configured to reduce turbulence and/or break down vapor bubbles within the flow of the fluid preceding the inlet of the circulation pump.

33. The dishwasher of claim 27, wherein the at least one first upper guide vane is configured to destroy and/or prevent formation of vortices within the flow of the fluid preceding the inlet of the circulation pump.

34. A dishwasher comprising:

a sump;

a circulation pump having an inlet disposed in the sump; and a pump plate for conditioning fluid flow preceding the inlet of the circulation pump, the pump plate comprising:

a plate portion defining a first surface and a second surface;

a plurality of holes defined in the plate portion and extending between the first surface and the second surface, wherein the plurality of holes are dispersed across the plate portion and configured to allow fluid to pass through plate portion;

a plurality of first upper guide vanes extending outwardly from the first surface, each of the plurality of first upper guide vanes (a) extending along a portion of the first surface of the plate portion and (b) being parallel to another of the plurality of first upper guide vanes;

a plurality of second upper guide vanes extending outwardly from the first surface, each of the plurality of second upper guide vanes (a) extending along a portion of the first surface of the plate portion and (b) being parallel to another of the plurality of second upper guide vanes wherein at least two of the plurality of first upper guide vanes and the plurality of second upper guide vanes extend outwardly from the plate portion at different heights; and at least one attachment feature, wherein the attachment feature is configured to attach to a portion of the dishwasher to secure the pump plate within the dishwasher; and wherein the pump plate is secured within the dishwasher via the at least one attachment feature such that the pump plate fluidly encloses an area preceding the inlet of the circulation pump such that fluid within the dishwasher flows through the pump plate prior to entering the inlet of the circulation pump.

35. The dishwasher of claim 34, wherein the pump plate further comprises:

a first lower guide vane extending outwardly from the second surface, wherein the first lower guide vane defines a first side and a second side; and a second lower guide vane extending outwardly from the first side and the second side of the first lower guide vane, wherein the second lower guide vane extends in a plane that is perpendicular to the first lower guide vane and parallel to the plate portion.

36. A method for manufacturing a dishwasher, the method comprising:

providing a pump plate for conditioning fluid flow preceding an inlet of a circulation pump of a dishwasher, the pump plate comprising:

a plate portion defining a first surface and a second surface;

a plurality of holes defined in the plate portion and extending between the first surface and the second surface, wherein the plurality of holes are dispersed across the plate portion and configured to allow fluid to pass through the plate portion;

a plurality of first upper guide vanes extending outwardly from the first surface, each of the plurality of first upper guide vanes (a) extending along a portion of the first surface of the plate portion and (b) being parallel to another of the plurality of first upper guide vanes;

at least one second upper guide vane extending outwardly from the first surface, wherein the at least one second upper guide vane intersects with at least one first upper guide vane of the plurality of first upper guide vanes; and securing the pump plate within the dishwasher to fluidly-enclose an area preceding the inlet of the circulation pump such that fluid within the dishwasher flows through the pump plate prior to entering the inlet of the circulation pump.

* * * * *